United States Patent [19]

Bonner

[11] 4,420,846

[45] Dec. 20, 1983

[54] SPA SYSTEM

[76] Inventor: Jack D. Bonner, 3938 Deer Haven Ct., Las Vegas, Nev. 91820

[21] Appl. No.: 340,815

[22] Filed: Jan. 19, 1982

Related U.S. Application Data

[63] Continuation-in-part of Ser. No. 226,528, Jan. 19, 1981, abandoned.

[51] Int. Cl.[3] ..... A47C 19/12; A61H 9/00

[52] U.S. Cl. ..... 4/542; 4/541; 4/544

[58] Field of Search ..... 4/541, 542, 544, 492, 4/507; 128/66

[56] References Cited

U.S. PATENT DOCUMENTS

| | | | |
|---|---|---|---|
| 3,391,870 | 7/1968 | Nash | 4/559 X |
| 3,396,722 | 8/1968 | Lindberg, Jr. | 4/559 X |
| 3,890,655 | 6/1975 | Mathis | 4/542 |
| 3,890,656 | 6/1975 | Mathis | 4/542 |
| 3,946,449 | 3/1976 | Mathis | 4/542 |
| 4,225,984 | 10/1980 | Lindsay | 4/541 |
| 4,240,166 | 12/1980 | Altman et al. | 4/542 |
| 4,262,371 | 4/1981 | Barry et al. | 4/492 X |
| 4,264,039 | 4/1981 | Moreland | 4/542 |
| 4,320,541 | 3/1982 | Neenan | 4/542 X |
| 4,335,854 | 6/1982 | Raynoso | 4/542 X |
| 4,339,833 | 7/1982 | Mandell | 4/541 X |
| 4,340,039 | 7/1982 | Hibbard et al. | 4/542 X |
| 4,358,862 | 11/1982 | Altman et al. | 4/541 X |

*Primary Examiner*—Henry K. Artis

*Attorney, Agent, or Firm*—Poms, Smith, Lande & Rose

[57] ABSTRACT

A spa system particularly adapted for installation as part of a bathtub within the home. The various jets are fed recirculated water from a pump by individual lines from a manifold to assure equal output regardless of its distance from the pump. The jets are venturi-type jets of the type to aspirate and entrain air in the output stream. The jets are connected to an adjustable air inlet system designed to allow adjustment of the air being aspirated into the water stream as well as preventing undesired water splash or spray therefrom in the event of jet blockage.

15 Claims, 13 Drawing Figures

SPA SYSTEM

BACKGROUND OF THE INVENTION

This application is a Continuation-in-Part of application Ser. No. 226,528, filed Jan. 19, 1981 and now abandoned.

The present invention relates to spa systems and, more particularly, to spa systems of the recirculating type wherein water is drawn from a tub and recirculated through jets to create a turbulent environment typically having water bubbles entrained as a part thereof.

Spa systems are known in the art and have gained increased popularity over the past few years. In the typical spa system, water is drawn through a drain in the bottom of a tub into a pump and recirculated therefrom back into the tub through a series of jet openings disposed about its periphery. It is also very popular to include entrained bubbles within the emerging water stream from the jets. This is accomplished in two ways. In one type of system, the water and air are fed to the nozzle in separate pressurized lines. This, of course, requires the use of a so-called "jet pump" to provide the pressurized air.

In the other type of system, the water is passed through the jet under pressure and the jet is constructed with a venturi to create a low pressure area therein. A conduit is provided communicating between the venturi throat and the atmosphere. As a result, air is aspirated into the water stream and creates bubbles entrained therein.

With the increased acceptance of such spa systems and recognition of the therapeutic value thereof, there has been an increase in the number of such systems provided for installation within homes, particularly as a replacement for a conventional bathtub. Because of the crowded conditions for installation in such cases, certain problems are created. Additionally, because the tub is located within the house and not outside where splashing is acceptable, provision must be made to prevent undesired spray and splash which can occur if, for example, a person within the tub leans against or otherwise blocks the egress of water from one of the jets.

Wherefore, it is the object of the present invention to provide an improved spa system particularly adapted for installation within a bathtub located within a home or other dwelling place.

DESCRIPTION OF SEVERAL EMBODIMENTS

Figure 1:
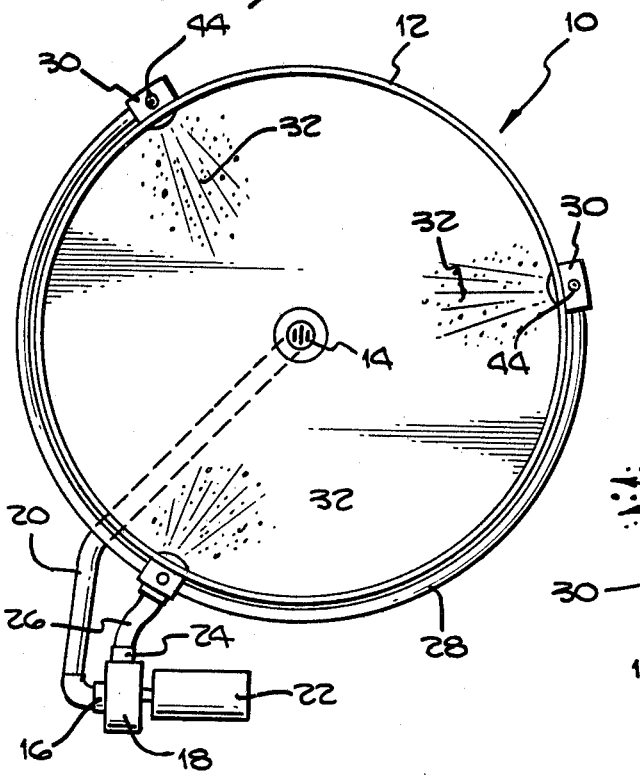
Fig. 1. PRIOR ART
FIG. 1 is a plan view of a prior art recirculating spa system.

FIG. 1 shows a plan view of a prior art spa system, generally indicated as 10. A tub 12 has a drain 14 in the bottom connected to the inlet 16 of pump 18 by inlet line 20. Typically, the lines and fittings of contemporary spa systems, including the jets, are made of plastic. The spa system of the present invention to be described herein after is particularly adapted for such construction. The pump 18 is driven by an electric motor 22. Its outlet 24 is connected through outlet line 26 to circumferential line 28 having jets 30 disposed therein. In such a system, one problem is that the jet 30 closest to the pump 18 has a maximum emitted stream of water and bubbles 32 while the emitted streams 32 of the other jets 30 are diminished because of their distance within the common line 28 from the pump 18.

Figure 2:
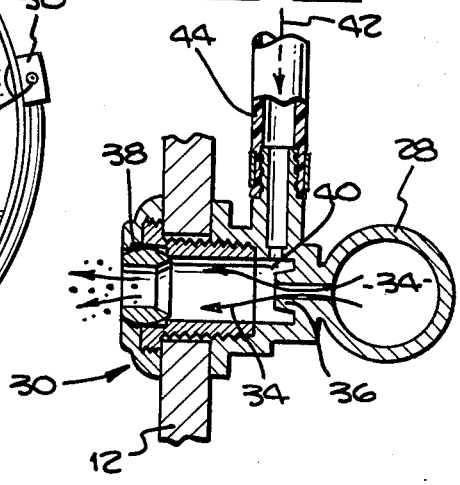
Fig. 2. PRIOR ART
FIG. 2 is a cutaway side elevation through one of the jets of the spa system of FIG. 1.

One of the jets 30 is shown in cutaway side elevation in FIG. 2. The water 34 within the circumferential line 28 exits therefrom through the nozzle 36 directed towards the positionable outlet nozzle 38. In so doing, a low pressure area is created at 40 adjacent the nozzle 36. Air 42 enters through the air aspiration line 44 and is entrained with the water 34 to create the emitted stream 32.

Figure 3:
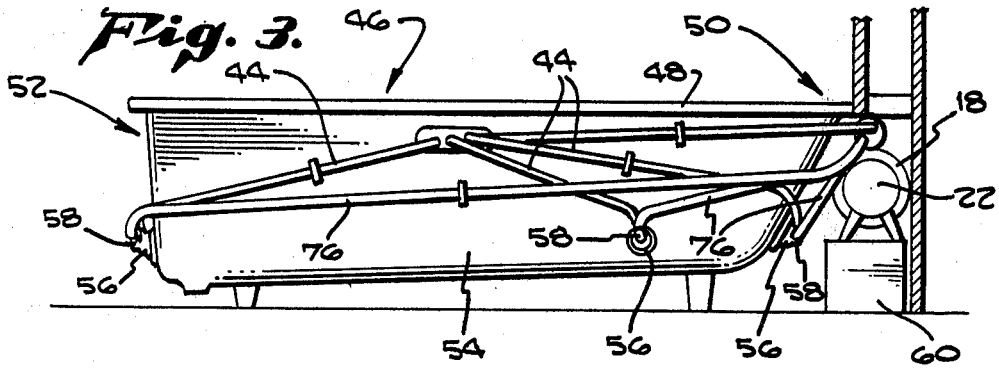
FIG. 3 is a side elevation of a spa system according to the present invention.
Figure 4:
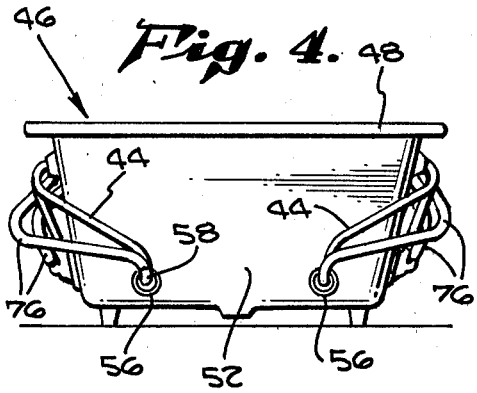
FIG. 4 is a foot elevation of the spa system of FIG. 3.
Figure 5:
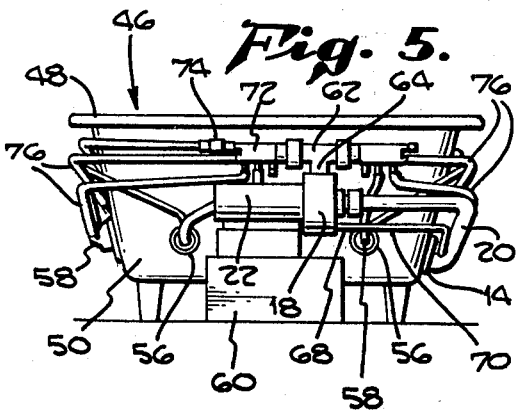
FIG. 5 is a head elevation of the spa system of FIGS. 3 and 4.

Turning now to FIGS. 3–5, a spa system, generally indicated as 46, according to the present invention is shown. The tub 48 is of a conventional bathing variety having a head 50, a foot 52, and two sides 54. A plurality of jets 56 are provided at spaced intervals about the tub 48 in a pattern which will produce the desired water flow action. The jets are of the air aspiration variety such as shown in FIG. 2. The common circumferential line 28 thereof is replaced by individual water inlets 58 to be connected in the manner described hereinafter.

A pump 18 driven by an electric motor 22 is positioned by the head 50. It could, of course, be positioned elsewhere if more convenient. The pump 18 and motor 22 are elevated on platform 60 to provide maximum drainage of the system when the tub is drained to prevent water from lying stagnant within the pump and connecting lines.

Figure 6:
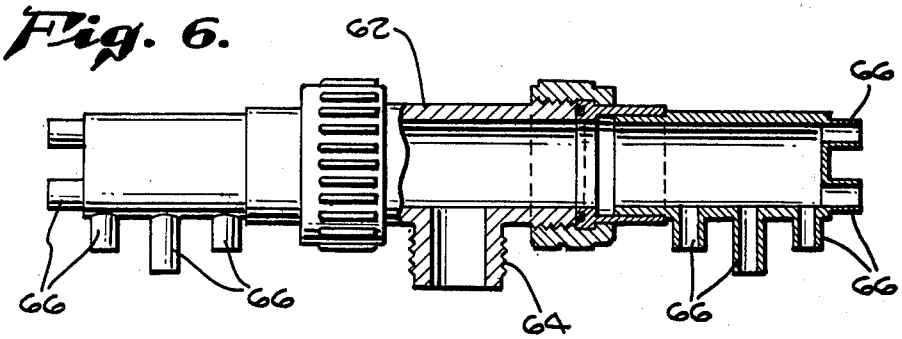
FIG. 6 is a partially cutaway elevation of the manifold system for the high-pressure water according to the present invention.
Figure 7:
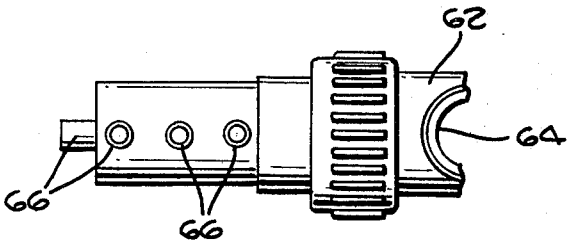
FIG. 7 is a bottom view of one end of the manifold of FIG. 6.
Figure 8:
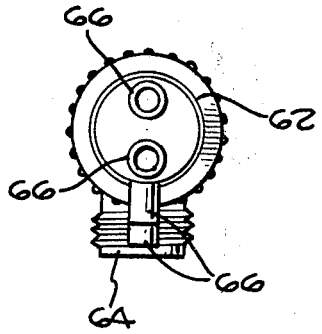
FIG. 8 is an end view of the manifold of FIGS. 6 and 7.

The outlet 24 of the pump 18 is connected to a manifold 62 which is shown in greater detail in FIGS. 6–8. The manifold 62 is positioned above the pump 18 so as to place it as high as possible on the tub 12. Manifold 62 has its inlet 64 connected to the outlet 24 of pump 18. Manifold 62 is also provided with a plurality of outlet nipples 66 which are individually connected to respective ones of the water inlets 58 of the jets 30. As can be seen, the outlet nipples 66 are placed in close adjacent relationship at a distance from the inlet 64. By so doing, the internal water pressure at each outlet nipple 66 is substantially identical. In this manner, each jet 30 receives a substantially identical quantity of water.

Several additional features of this portion of the spa system 46 are important. The inlet 16 of pump 18 is connected by a line 20 to a drain 14 at the lowest point of the tub 48. Additionally, the volute 68 of pump 18 is connected by line 70 to the drain line 20 adjacent the drain 14 to provide complete drainage of the pump 18 upon drainage of the tub. Additionally, an air inlet 72 is provided on the highest point of the manifold 62 and is connected through a one-way check valve 74 to the source of aspirated air to be described hereinafter. Check valve 74 is connected to allow air to enter the manifold 62 when the system is draining and to close and prevent the outflow of water when the manifold 62 is pressurized with water.

The nipples 66 are connected to the water inlets 58 of the respective jets 56 by individual lines 76. Because of the placement of the manifold 62, it can be seen that the lines 76 all slope downwardly toward the jets 56 aiding in drainage of the system. The jets 56 also have an air aspiration line 44 in the manner of the jets 30 of FIG. 2. The air aspiration lines 44 are individually connected to an air manifold 78 which is to be described in various configurations hereinafter.

Figure 9:
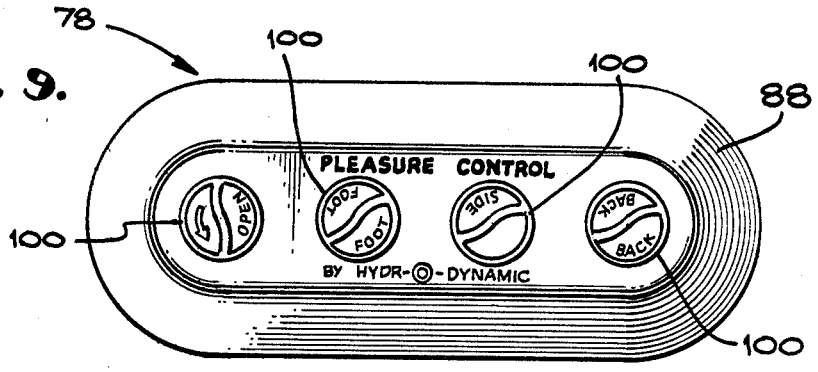
FIG. 9 is a plan view of an air inlet controller according to one embodiment of the present invention.
Figure 10:
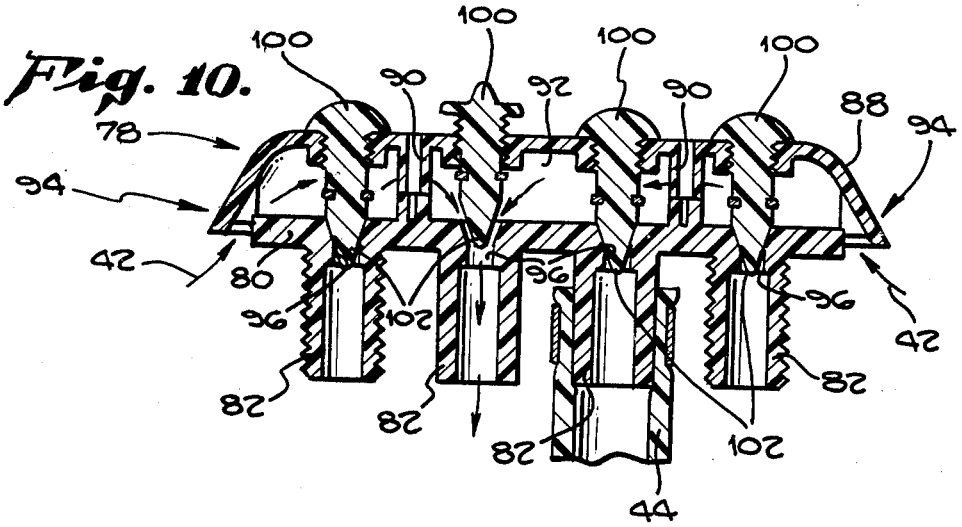
FIG. 10 is a cutaway elevation of the controller of FIG. 10.
Figure 11:
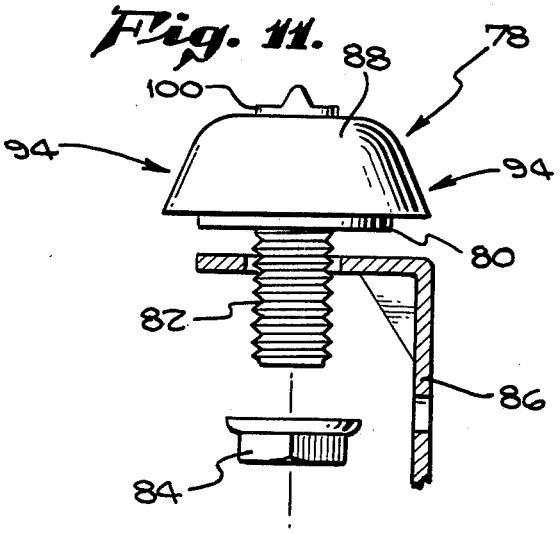
FIG. 11 is an end view of the controller of FIGS. 9 and 10.

Turning now to FIGS. 9–11, the air manifold 78 is shown in a first embodiment. Air manifold 78 comprises a base plate 80 having connecting nipples 82 extending downward therefrom. The two end nipples 82 are threaded so that the air manifold 78 can be mounted as with nuts 84 to a bracket 86. Other methods could, of course, be used. The air aspiration lines 44 from the jets 56 are connected to the nipples 82 to effect the desired control. The air manifold 78 is provided with a deflector cover 88 which is connected to the base plate 80 by posts 90. The cover 88 is spaced from the base plate 80 to create a chamber 92 therebetween. About its periphery, as in the areas designated 94, the cover 88 is shaped to deflect water entering the chamber 92 and exiting therefrom downward back into the tub 48 when the manifold 78 is positioned within the tub 48 above the surface of the water therein. The cover 88 also prevents splashed water from entering the aspirated air stream.

To provide the desired control, the base plate 80 is provided with a passageway 96 adjacent each nipple 82 and communicating from the interior thereof into the chamber 92. A threaded valve member is threadedly disposed into the deflector cover 88 adjacent respective ones of the passageways 96. The valve members 98 have a top portion 100 adapted to be gripped and twisted by an occupant of the tub thereby to be screwed into and out of the cover 88. The lower portion 100 thereof is designed to engage the passageway 96 so as to seal it off in the lower position and increasingly open it as the valve member 98 is screwed outwardly from the deflector cover 88.

Figure 12:
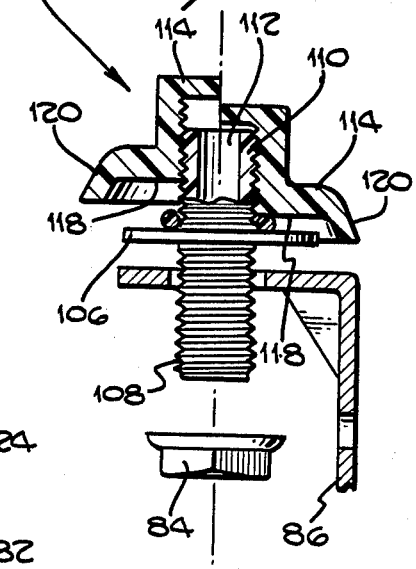
FIG. 12 is a partially cutaway view of an air controller according to the present invention in a second embodiment thereof.

Turning to FIG. 12, a second embodiment is shown for the air inlets. In this embodiment, each air aspiration line 44 is connected to a single air inlet controller 104. Each controller 104 comprises a base 106 having a first nipple 108 extending downward therefrom and a second nipple 110 coaxial with the first nipple 108. Both nipples are threaded so that a nut 84 can be used to mount the controller 104 to a bracket 86 in the manner of the previous embodiment. There is a hole (not shown) in the base 106 such that a passageway 112 extends through the nipple 108, 110 and base 106. A threaded deflector knob 114 is threadedly engaged on the second nipple 110. In FIG. 12, the knob 114 is shown split in its closed and open positions. The threads of the deflector knob 114 are made for loose engagement with the threads on the second nipple 110 such that air can pass therebetween. An O-ring 116 is disposed about the base of the second nipple 110 as shown. When the threaded deflector knob 114 is turned to its completely downward position with its underside 118 pressed against the O-ring 116, no air can enter. As the deflector knob 114 is raised, however, air can pass between the threads and into the aspiration line 44 connected to the first nipple 108. It will be noted that the deflector knob 114 has the outer periphery thereof shaped as a deflector in the manner of the cover 88 of the previous embodiment. That is, the outer periphery in the area designated as 120 curves smoothly downward so that any water that backs through the threads and emerges adjacent the underside 118 will be deflected downward back into the tub by the deflection area 120 of knob 114.

Figure 13:
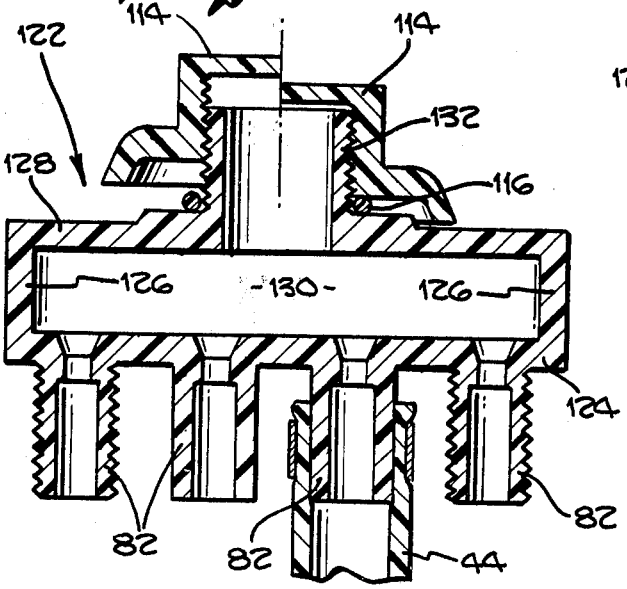
FIG. 13 is a cutaway elevation of an air controller according to a third embodiment of the present invention.

A third embodiment, combining the features of the two previous embodiments, is shown in FIG. 13. In this embodiment, an air inlet controller 122 comprises a base 124 having nipples 82 in the manner of the embodiment of FIGS. 9–11. The base 124, however, has sides 126 and a top 124 affixed thereto, to define a chamber 130. A nipple 132 extends upward from top 128 and communicates with the chamber 130. A threaded deflector knob 114 and O-ring 116 are mounted to the nipple 132 to operate in the same manner as the corresponding parts in the embodiment of Figure.

Wherefore, it can be seen that the spa system of the present invention provides an improved system for installation within a home environment providing equalized water pressures, complete drainage, and an adjustable air inlet which prevents the egress of water from the tub environment.

Having thus described my invention, I claim:

1. In a recirculating spa system wherein water is drawn from a tub containing water and pumped back into the tub by a pump through jets to cause an entering air/water mixture, the improvement comprising:

(a) water manifold means located generally adjacent said pump on one side only of said tub for receiving water exiting the pump and maintaining a supply of such water within a water chamber thereof at substantially equal water pressures throughout said chamber, said manifold means having a plurality of water exit openings equal in number to the number of jets being used in the tub and being positioned relative said chamber to receive equal water pressure; and (b) individual water connecting conduits connecting the jets to respective ones of said water exit openings.

2. In a recirculating spa system wherein water is drawn from a tub containing water and pumped back into the tub by a pump through jets to cause an entering air/water mixture, the improvement comprising:

a water manifold having a water receiving chamber disposed to receive water exiting the pump, said manifold having a plurality of water exit openings equal in number to the number of jets being used in the tub and being positioned relative said water receiving chamber to receive equal water pressure; and, individual water connecting conduits connecting the jets to respective ones of said water exit openings, wherein:

(a) the jets are venturi jets wherein each jet has an air inlet through which air is drawn as a result of the water passing through the jet; and additionally comprising, (b) an air manifold having an air inlet to an air chamber and a plurality of air exit openings from said air chamber; and, (c) individual air connecting conduits connecting the air inlets of the jets to respective ones of said air exit openings.

3. The improvement to a spa system of claim 2 wherein:

(a) said air manifold is adapted for mounting to the tub above the level of the water in the tub; and, (b) said air manifold includes a cover over said air inlet to prevent splashed water from entering said chamber.

4. The improvement to a spa system of claim 3 wherein:

said air exit openings each include valve means for individually regulating the air flow to each jet.

5. The improvement to a spa system of claim 3 wherein:

said cover is curved to deflect any water entering said air manifold and exiting therefrom back into the tub.

6. The improvement to a spa system of claim 2 and additionally comprising:

(a) a conduit operably connected between said water manifold and said air manifold; and, (b) a check valve disposed in said conduit to permit air to flow to said water manifold and to block the flow of water to said air manifold.

7. In a recirculating spa system wherein water is drawn from a tube containing water and pumped back into the tub by a pump through jets to cause an entering air/water mixture, the improvement comprising:

a water manifold having a water receiving chamber disposed to receive the water exiting the pump, said manifold having a plurality of water exit openings equal in number to the number of jets beings used in the tub and being positioned relative said water receiving chamber to receive equal water pressure; and, individual water connecting conduits connecting the jets to respective ones of said water exit openings, wherein:

(a) the jets are venturi jets wherein each jet has an air inlet through which air is drawn as a result of the water passing through the jet; and additionally comprising, (b) a plurality of air manifolds connected to respective ones of said air inlets, each manifold having an inlet for air including valve means for controlling the amount of air including valve means for controlling the amount of air entering therein and deflector means for deflecting any water entering said air manifold and exiting therefrom back into the tub.

8. In a recirculating spa system wherein water is drawn from a tub containing water and pumped back into the tub by a pump through jets to cause an entering air/water mixture, the improvement comprising:

a water manifold having a water receiving chamber disposed to receive the water exiting the pump, said manifold having a plurality of water exit openings equal in number to the number of jets being used in the tub and being positioned relative said water receiving chamber to receive equal water pressure; and, individual water connecting conduits connecting the jets to respective ones of said water exit openings, wherein:

(a) the jets are venturi jets wherein each jet has an air inlet through which air is drawn as a result of the water passing through the jet; and additionally comprising, (b) an air manifold having an air inlet to an air chamber including valve means for controlling the amount of air entering therein and deflector means for deflecting any water entering said air manifold and exiting thereform back into the tub, and a plurality of air exit openings from said air chamber; and (c) individual air connecting conduits connecting the air inlets of the jets to respective ones of said air exit openings.

9. In a recirculating spa system wherein water is drawn from a tub containing water and pump back into the tub by a pump through jets to cause an entering air/water mixture, a water manifold adapted to be disposed between the outlet of the pump and the jets to provide equal water flow to all jets comprising:

manifold means located generally adjacent said pump on one side only of said tub defining a chamber having an inlet opening to the outlet of the pump for receiving water exiting the pump and maintaining a supply of such water within a water chamber thereof at substantially equal water pressures throughout said chamber, said manifold means having a plurality of outlet nipples from said chamber adapted to be connected to respective ones of jets, said nipples being disposed such as to be at points of substantially equal pressure and flow potential whereby all the jets receive equal water.

10. In a recirculating spa system wherein air is drawn from a tub containing water and pumped back into the tub by a pump through air aspirating jets to cause an entering air/water mixture, an air manifold adapted to be connected to the jets to provide air thereto comprising:

a manifold body defining a chamber, said body having an inlet for air including valve means for controlling the amount of air entering therein and deflector means for deflecting any water entering said air manifold and exiting therefrom back into the tub, said manifold body further having a plurality of air exit openings from said chamber adapted to be connected to the air inlets of the air aspirating jets.

11. The air manifold for a spa system of claim 10 wherein:

said valve means comprises individual valves for controlling the air to each of said air exit openings.

12. In a recirculating spa system wherein air is drawn from a tub containing water and pumped back into the tub by a pump through air aspirating jets to cause an entering air/water mixture, an air manifold adapted to be connected to the jets to provide air thereto comprising:

a manifold body defining a chamber, said body having an inlet for air including valve means for controlling the amount of air entering therein and deflector means for deflecting any water entering said air manifold and exiting therefrom back into the tub, said manifold body further having an air exit opening from said chamber adapted to be connected to the air inlets of the air aspirating jets.

13. The air manifold for a spa system of claim 12 or claim 12 wherein said inlet for air including valve means comprises:

(a) a threaded nipple communicating with said chamber; and, (b) a cap threaded onto said nipple with the threads of said cap and nipple having sufficient clearance for the passage of air three-between.

14. The air manifold for a spa system of claim 13 wherein:

said threaded cap has the outer periphery shaped to perform the function of said deflector means.

15. The air manifold for a spa system of claim 13 and additionally:

an O-ring positioned about said nipple to seal against said cap when said cap is screwed onto said nipple fully to an "off" position whereby no air can pass between said threads in said "off" position.

* * * * *